US006564887B2

(12) United States Patent
Hong et al.

(10) Patent No.: US 6,564,887 B2
(45) Date of Patent: May 20, 2003

(54) CORE DRILL

(75) Inventors: Jae Hyun Hong, Kyongki-Do (KR); Chang Hyun Lee, Kyongki-Do (KR); See Hyung Kim, Kyongki-Do (KR)

(73) Assignee: Ehwa Diamond Ind. Co., Ltd. (KR)

( * ) Notice: Subject to any disclaimer, the term of this patent is extended or adjusted under 35 U.S.C. 154(b) by 0 days.

(21) Appl. No.: 09/887,102

(22) Filed: Jun. 25, 2001

(65) Prior Publication Data

US 2002/0112895 A1 Aug. 22, 2002

(30) Foreign Application Priority Data

Feb. 19, 2001 (KR) ..... 2001-8264

(51) Int. Cl.[7] ..... E21L 13/02

(52) U.S. Cl. ..... 175/395; 175/405; 408/145; 451/542

(58) Field of Search ..... 175/395, 398, 175/405; 451/540, 542; 408/145, 204

(56) References Cited

U.S. PATENT DOCUMENTS 3,888,320 A * 6/1975 Maxwell ..... 175/394
4,202,420 A * 5/1980 Peetz et al. ..... 175/395
5,167,475 A * 12/1992 Miyanaga ..... 408/204
5,316,416 A * 5/1994 Kim ..... 408/145
5,392,759 A * 2/1995 Kwang ..... 125/15
6,033,295 A * 3/2000 Fischer et al. ..... 451/540

FOREIGN PATENT DOCUMENTS

KR 1996/9996713 1/1999
KR 2000/0015639 8/2000

* cited by examiner

*Primary Examiner*—William Neuder
(74) *Attorney, Agent, or Firm*—Burns Doane Swecker & Mathis, LLP

(57) ABSTRACT

The present invention relates to a core drill wherein initial drilling workability is improved through reduced frictional resistance on the segment tips, when they are seated on the surface of an article to start cutting operation, and wherein cutting scraps or sludge produced by the segment tips are smoothly discharged through the helical grooves formed on the core body so as to reduce the friction between the core body and the cutting scraps or sludge, whereby both the cooling and cutting performance of the core drill are improved. The invention proposes a core drill with a cylindrical core body with a predetermined diameter and length and with plural cutting segments provided on the lower part of a core body at a finite interval, wherein the cutting thickness surface of the cutting segment consists of inclined sharp thickness portion for decreased frictional resistance with an article to be processed.

12 Claims, 10 Drawing Sheets

CORE DRILL

FIELD OF THE INVENTION

The present invention relates to a core drill for forming a hole in the form of a cylinder in materials like stones, base rocks or concrete structure and particularly to a core drill wherein initial frictional resistance for segment tips is reduced at the time of settling on an article to be processed for a hole to stabilize the initial work and helical groove is formed on the core body to facilitate the discharge of cut chips or wet sludge for improving cooling performance and for improving cutting performance through reduced rotational resistance.

BACKGROUND OF THE INVENTION

Generally, a core drill comprises a cylindrical core body with a finite diameter and length and segment tips of diamond fixed at the bottom surface of a core body for drilling an article, wherein the core drill is connectable to a drilling machine through screwed fixing part formed on the top of the core body.

Thus, the core drill is connected to a core drill machine and actuated to form a hole in a stone, concrete structure or base rock by cutting or drilling with the segment tips.

As prior art literatures, there are Korean utility model publication No. 1996-0006713(05.08.1996) to the present applicant and Korean unexamined U.M. publication No. 2000-0015639(05.08.2000) to S. H. Kang.

In the core drills according to the above-described prior disclosures, the cutting segment tips have flat thickness surface with a large surface area and experience a large frictional resistance in settling on an article and so tend to slip away, making initial settling difficult.

For example, when a worker tries to make a hole on the bottom or side wall of a concrete structure, he sets the core drilling machine in vertical or horizontal direction, causes the segment tips mounted on the core drill to make a close contact with the surface of concrete through application of force in the corresponding direction and then starts to perform drilling by actuating the core drilling machine. However, during some initial period he has to make several tries for settling the drill stably on the concrete because the segment tips easily slip off due to the small concentrated pressure from the large contacting surface between the concrete and segment tips, until he finally succeeds in drilling.

The above-described settling gets more difficult as the specification or the diameter of a core body increases, and on the other hand if the surface of the article to be processed is more slippery or its hardness is high, the settling gets more difficult. The settling or room making requires so much time in drilling operation that it influences the working efficiency and so the productivity.

On the other hand, the prior art core drills are each formed with one or more rows of helical grooves on the inside and outside or the outside only to guide and discharge the cut powder or sludge generated as the cutting segment tips perform drilling work.

Here, the problem is with the location of the starting positions of the helical grooves, because the starting points are positioned intermediately between the neighboring segment tips fixed on the bottom of a core body in ignorance of the cutting of a material taking place at the segment tips.

In other words, although connecting paths for conveying the cut chips or sludge produced at segment tips to the helical grooves need to be provided in order that the cut powder or sludge may be discharged along the helical grooves when a core drill is in operation of cutting an article with segment tips, the starting points of the helical grooves are positioned at a distance from segment tips, with no connecting paths provided. Thus, the cut scraps stay in motion between the segment tips for some while and only a part of them reaches the helical grooves to be discharged through the grooves, whereby smooth discharge of scraps is not realized. As a result, the remaining cut scraps may move un-oriented inwardly of the core body or outside the circumference of the core body and can come into contact with the scraps newly produced to increase the friction on the core body, so that the rotation of the core body is hindered and the cutting performance of the core drill is that much deteriorated.

SUMMARY OF THE INVENTION

The present invention was created to resolve the problems with the conventional art and so the object of the invention is to provide a core drill by which initial drilling workability is improved through reduced frictional resistance on the segment tips, when they are settled on the surface of an article to start cutting operation, and in which cut scraps or sludge produced by the segment tips are smoothly discharged through the helical grooves formed on the core body so as to reduce the friction between the core body and the cut scraps or sludge, whereby both the cooling and cutting performance of a core drill are improved.

The above object is achieved according to the invention by a core drill with a cylindrical core body with a predetermined diameter and length and with plural cutting segments provided on the lower part of a core body at a finite interval, wherein the cutting thickness surface of the cutting segment consists of inclined sharp thickness portion for decreased frictional resistance with an article to be processed.

Preferably, said sharp thickness portion is formed by inclination from the outside arc, the inside arc or from both the outside and inside arc of a segment tip.

According to another feature of the invention, the segment tips each including the sharp thickness portion from outside arc are arranged in one direction on a core body, or the segment tips each including the sharp thickness portion from outside arc and the segment tips each including the sharp thickness portion from inside arc are arranged alternately on a core body.

The object is also achieved according to another aspect of the invention by a core drill with a cylindrical core body with a predetermined diameter and length and with plural cutting segments provided on the lower part of a core body at a finite interval, wherein out of one or more rows of helical grooves formed from the bottom of a core body up toward the top at a finite interval on the surface of the core body, at least one row of helical groove has its starting point at a segment tip mounted on the under side of the core body.

Further preferably, one or more rows of helical grooves formed from the bottom of a core body up toward the top at a finite interval on the surface of the core body have their starting points at the segment tips mounted on the under side of the core body.

Still further, the inclination angle of said helical grooves preferably lies in the range between 1° and 90° relative to the horizontal.

Moreover, preferably the inclination angle of the helical grooves formed on the core body is the same as the inclination angle of the recesses or ridges formed on the arc part of the segment tips mounted on a core body.

According to still other feature of the invention, a plurality of openings in communication with the inside of a core body are formed between neighboring helical grooves on the core body.

DESCRIPTION OF THE PREFERRED EMBODIMENTS

Preferred embodiments of the invention are described in detail below by referring to the accompanying drawings.

Figure 1:
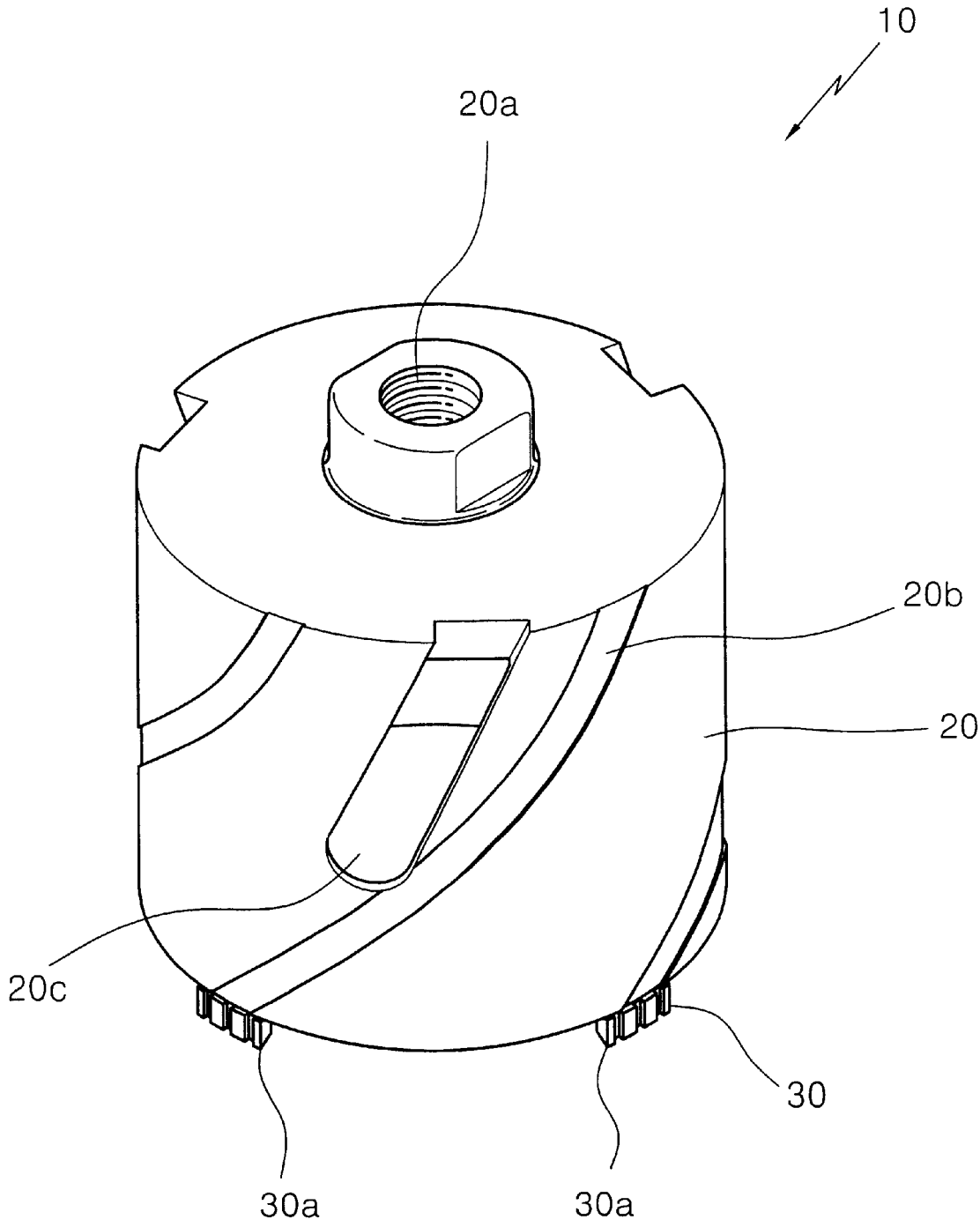
FIG. 1 shows the perspective view of a core drill according to the present invention.

FIG. 1 shows the illustrative core drill 10 according to the invention.

The core drill 10 comprises a core body 20 of steel material and plural segment tips 30 mainly of diamond mounted on the bottom surface of the core body 20 at a finite interval for cutting an article 100 to be processed.

The core body 20 is in the form of a cylinder with a predetermined diameter and length or height, wherein the under side is open in the form of a cylinder and the top side is closed, with a screw-threaded fixing section 20*a* formed centrally.

The core body 20 is formed on its outer circumference with helical grooves 20*b* for discharging cut scraps or sludge or for passing cooling water. This will be further described in the following.

And the core body 20 is formed with a plurality of openings 20*c* for communicating with the inside.

These openings 20*c* are intended to facilitate removal of the cut core not shown, when the cut core i.e. the piece cut-out from the article 100 is caught somehow inside the core body 20, and so these openings may be dispensed with when the length of a core drill is short enough.

The cutting part of a segment tip 30 is formed by sloped sharp thickness portions or cutting edges 30*a* in order to decrease the frictional resistance with an article 100 during initial settling against a workpiece.

Figure 2A:
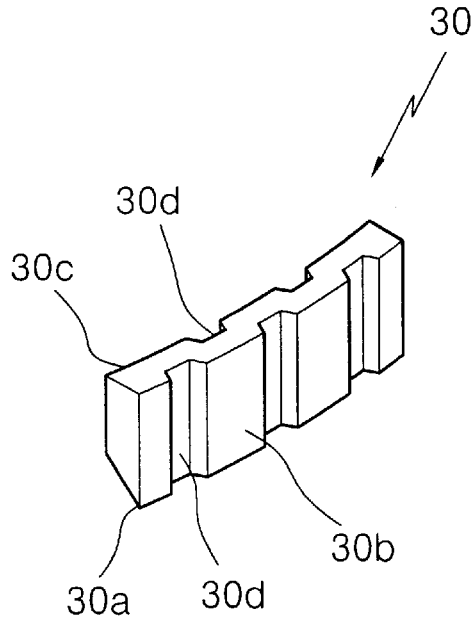
FIGS. 2*a* through 2*e* show the views of various variants for the segments tips shown in FIG. 1.
Figure 2B:
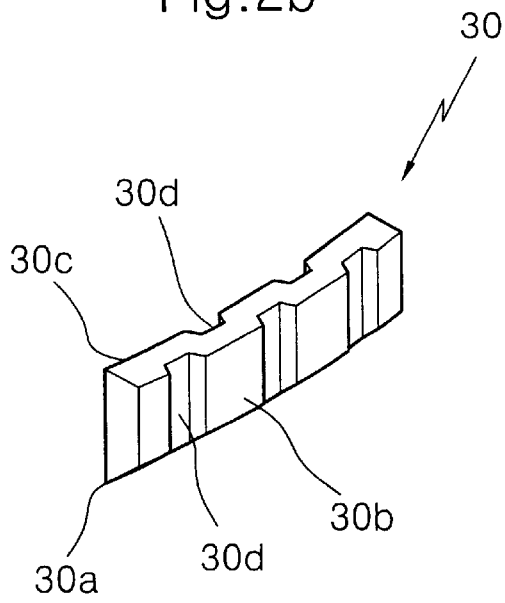
Figure 2C:
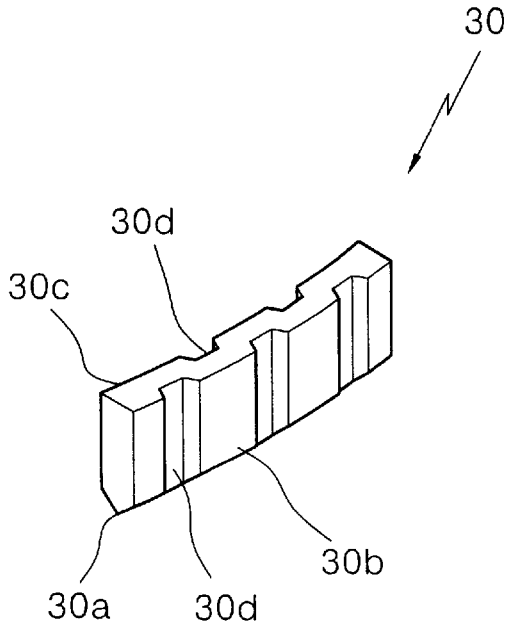

The cutting thickness portion 30*a* can be formed from the outside arc 30*b* and the sloped bottom surface, as shown in FIG. 2*a*, or can be defined substantially by the inside arc 30*c* and the sloped bottom surface, as shown in FIG. 2*b*, or otherwise by the triangle form slantingly formed from both the outside 30*b* and inside arc 30*c*, as shown in FIG. 2*c*.

Figure 3:
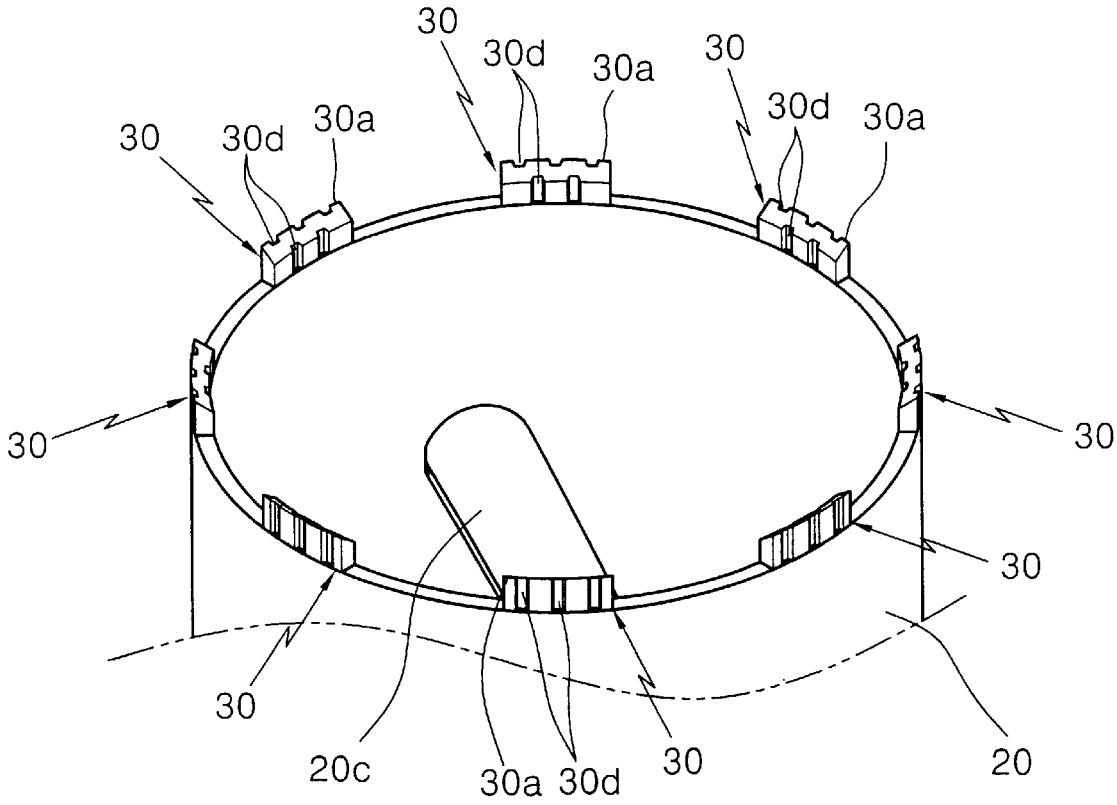
FIG. 3 shows the perspective view of a core drill shown as turned upside down.

FIG. 3 shows a core drill 10 according to the invention as turned upside down, wherein a plurality of segment tips 30 formed with the same sharp thickness portions 30*a* as shown in FIG. 2*a* are arranged in the same direction to a core drill 20 at a finite interval.

It will thus be appreciated that the cutting segment tips 30 are separately mounted at a front end of the body 20 and are spaced apart in a circumferential direction, considered with reference to a longitudinal axis of the body 20. Each cutting segment tip 30 is elongated in the circumferential direction and includes two non-parallel surfaces that converge forwardly and intersect to form a cutting edge 30*a* which is also elongated in the circumferential direction. One of the surfaces can be inclined relative to the axis in a direction extending both radially outwardly and axially forwardly (FIG. 2*a*). Alternatively, one of the non-parallel surfaces can be inclined in a direction both radially inwardly and axially outwardly (FIG. 2*b*). Also alternatively, one of the non-parallel surfaces can be inclined radially inwardly and axially forwardly and the other non-parallel surface inclined radially outwardly and axially forwardly (FIG. 2*c*).

Figure 4:
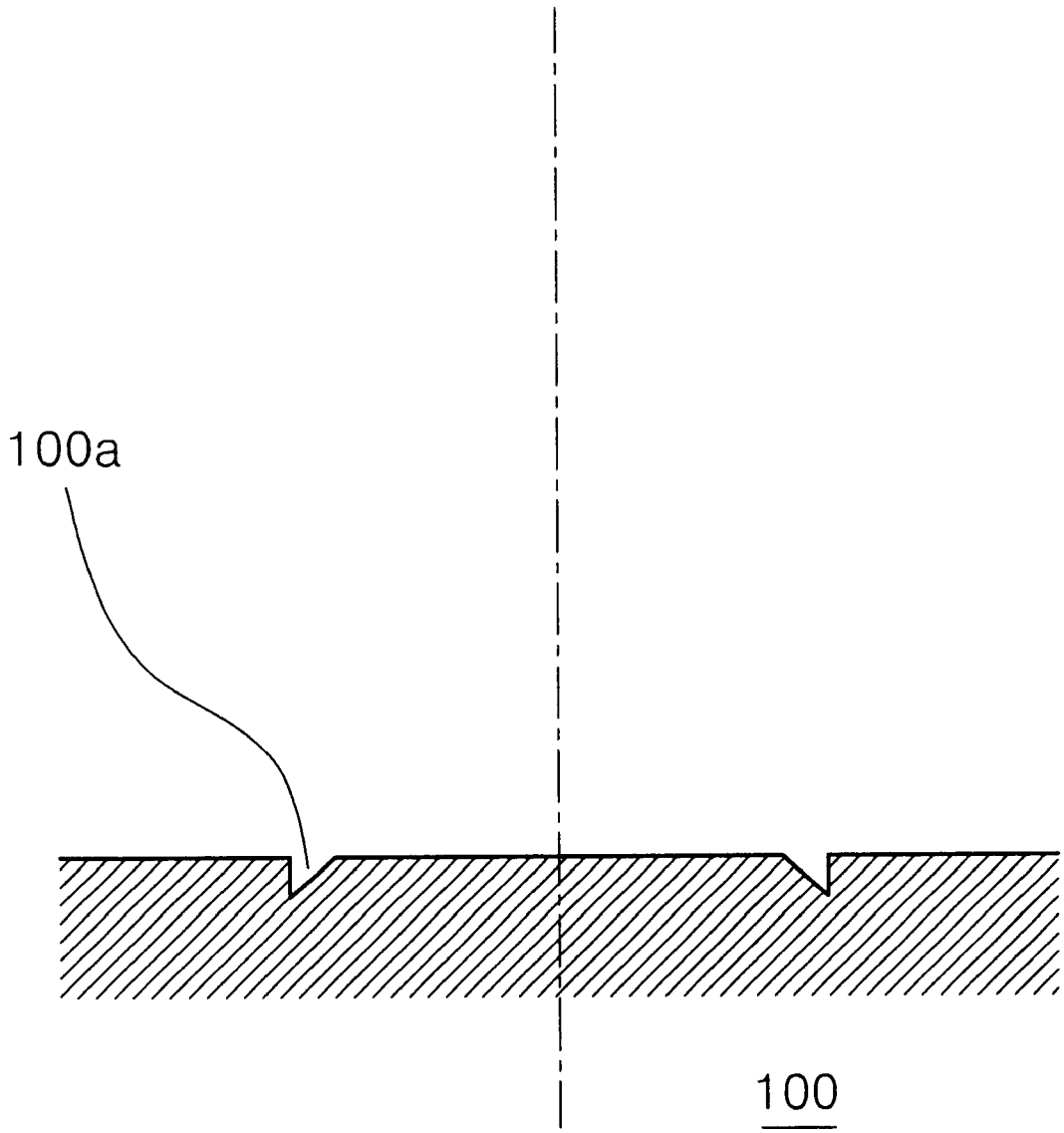
FIG. 4 shows the cross sectional view of the surface of an article notch-marked by the core drill shown in FIG. 3.

Accordingly, when the core drill 10 as shown in FIG. 3 is settled on the surface of an article 100 for drilling work as it rotates, a circular notch groove of one row 100*a* is formed on the surface of the article 100 due to the sharp thickness portions 30*a* from lined-up outside arcs 30*b*, as shown in FIG. 4.

Figure 5:
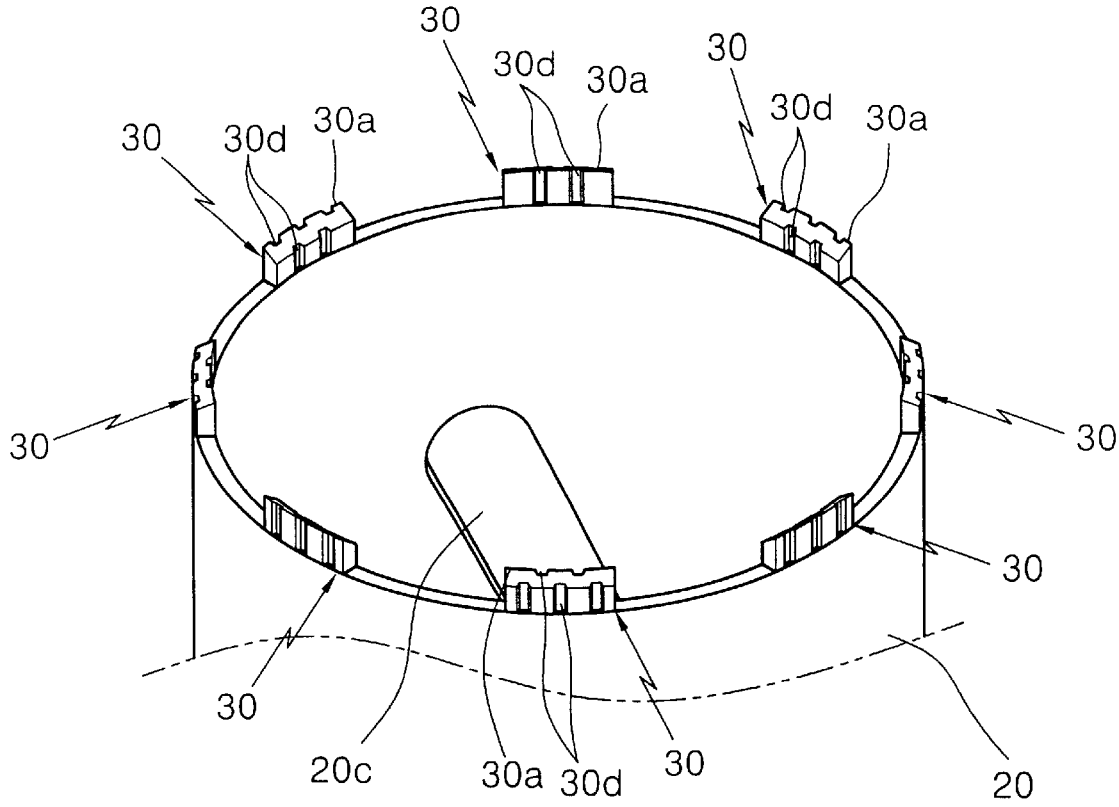
FIG. 5 shows a view illustrating a variant of FIG. 3.

FIG. 5 shows a core drill 10 according to the invention as turned upside down, wherein a plurality of segment tips 30 formed with the same sharp thickness portions 30*a* as shown in FIG. 2*a* and a plurality of segment tips 30 formed with the same sharp thickness portions 30*a* as shown in FIG. 2*b* are alternately and concentrically attached to a core drill 20 at a finite interval. Therefore, the edges 30*a* of some of the tips 30 are spaced farther from the axis of the body 20 than are the edges 30*a* of others of the tips 30.

Figure 6:
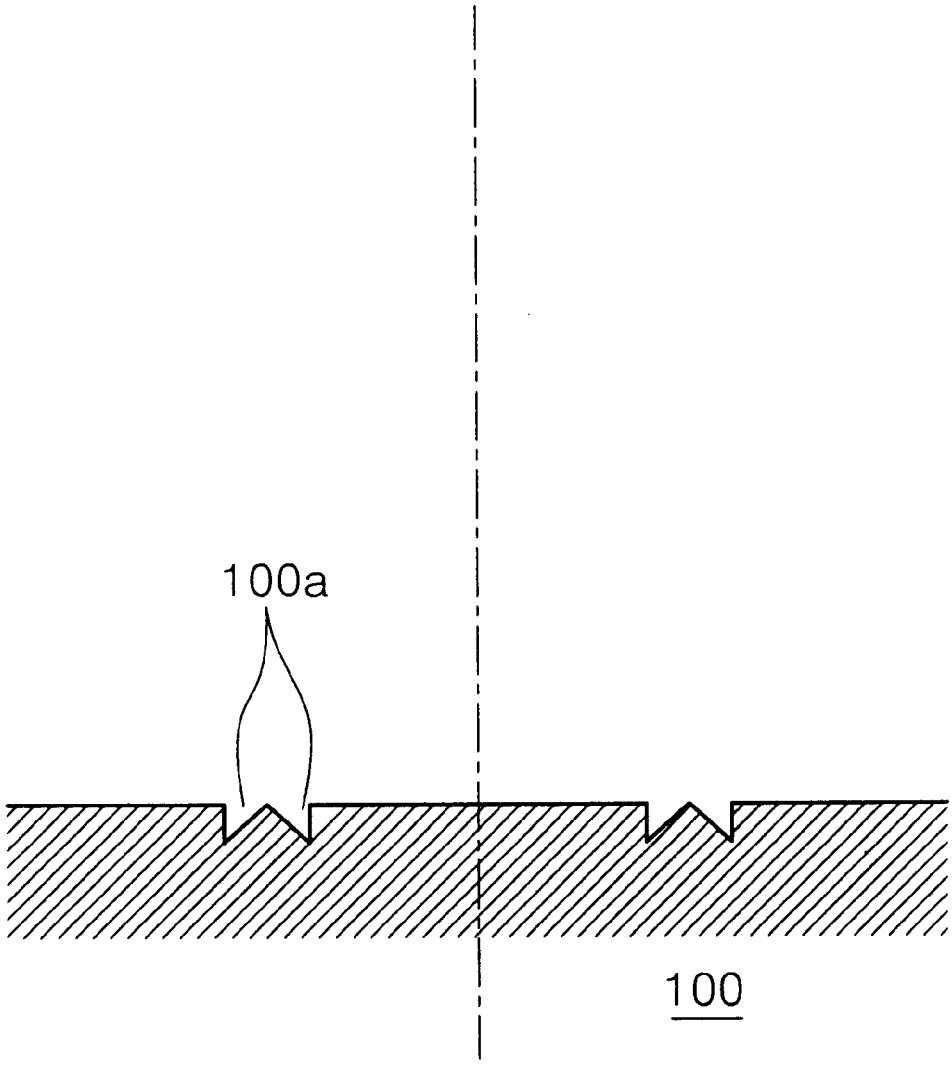
FIG. 6 shows the cross sectional view of the surface of an article notch-marked by the core drill shown in FIG. 5.

Accordingly, when the core drill 10 as shown in FIG. 5 is settled on the surface of an article 100 for drilling work as it rotates, a circular notch groove 100*b* of two rows is formed on the surface of the article 100 due to the sharp thickness portions 30*a* and 30*a* alternately arranged from the outside and inside arcs 30*a* and 30*b*, as shown in FIG. 6.

As described above, when initial settling on an article is made by using the segments 30 including sharp thickness portions 30*a*, the friction with the article being drilled is reduced during the settling, so that the workability is markedly improved.

Figure 2D:
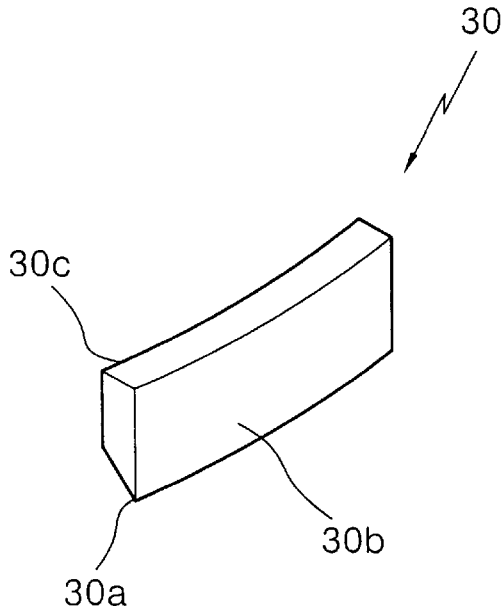
Figure 2E:
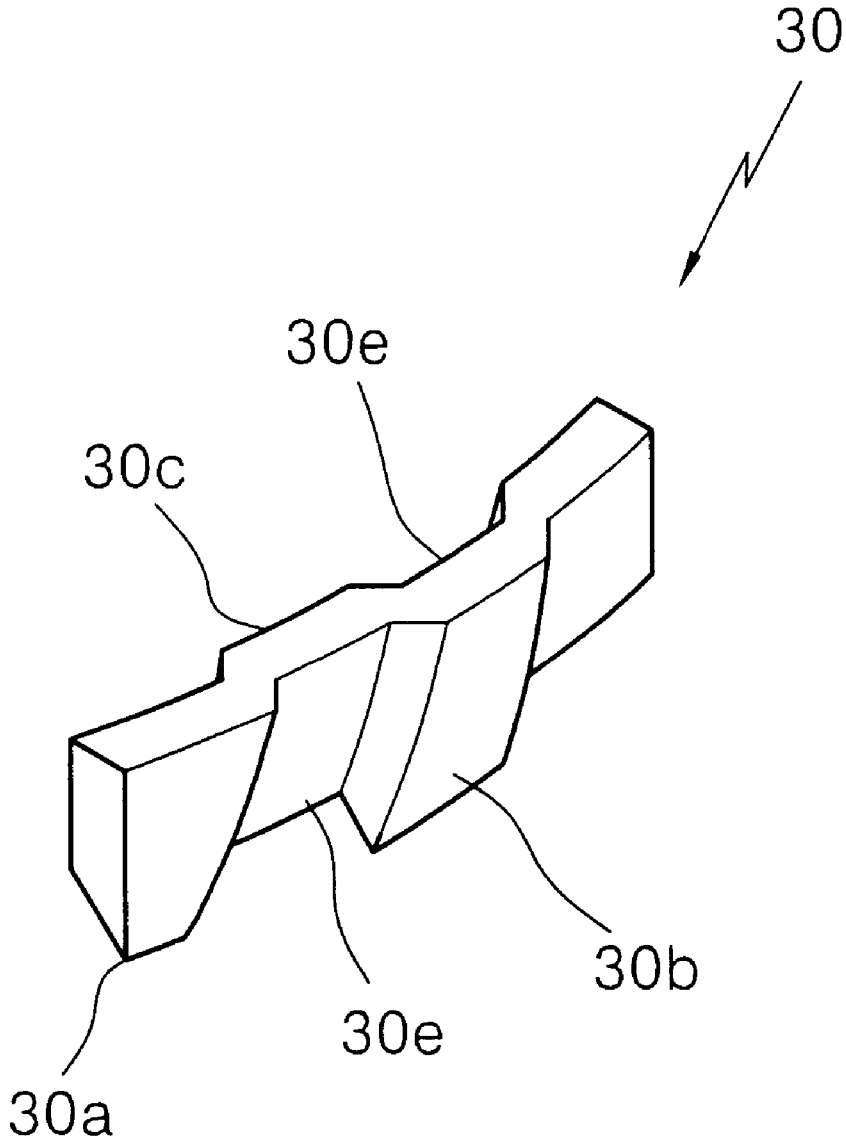

On the other hand, as shown in FIGS. 2*a*, 2*b* and 2*c*, for the purpose of improving the cutting function, the segment tips 30 may be composed of a plurality of outside and inside arcs 30*b* and 30*c*, with vertical recesses 30*d* sandwiched on both side surfaces in offset manner. Further, ordinary segment tips 30 without recesses on the arcs, as shown in FIG. 2*d*, may be used for the invention, or as shown in FIG. 2*e*, segment tips 30 each including the arcs 30*b* and 30*c* and the recesses 30*e* formed on both arcs at a finite angle may be used.

Figure 7:
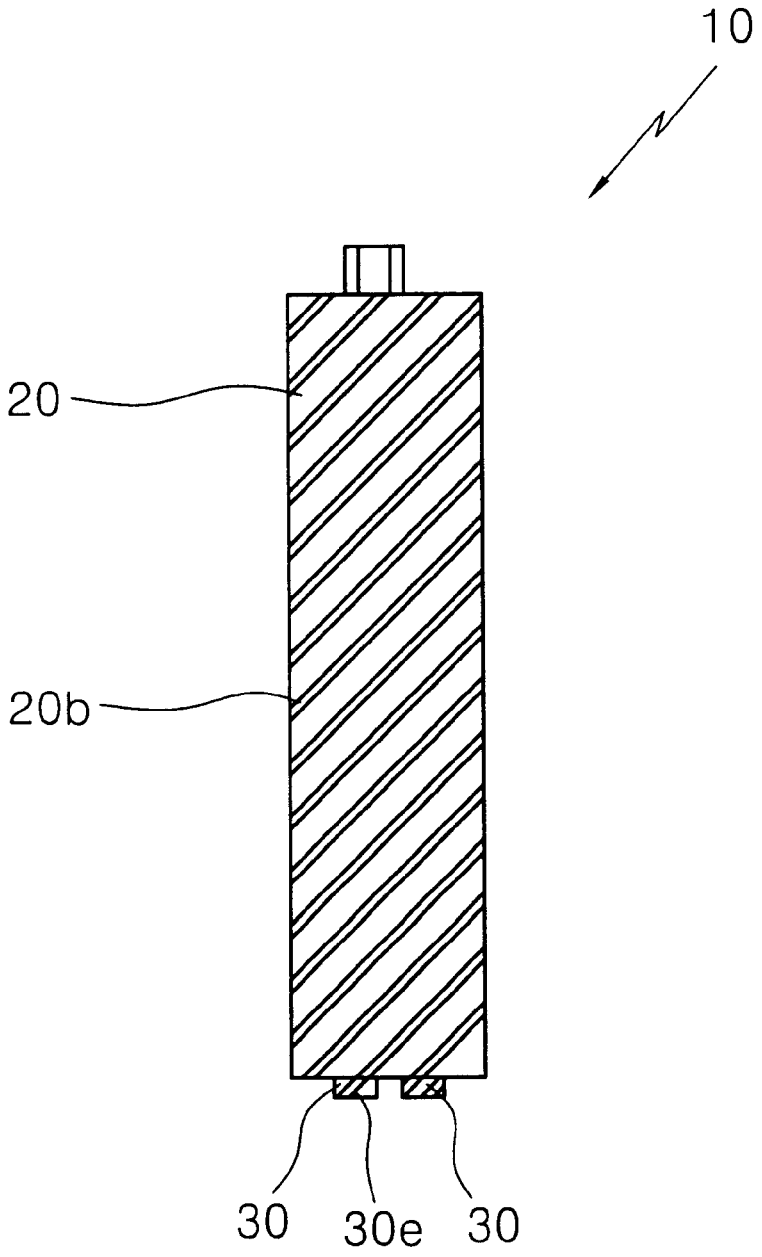
FIG. 7 shows the front view of a core drill according to the invention and FIG. 8 shows the front view of a core drill according to a variant embodiment of the invention.

The core body 20, as shown in FIG. 1 or 7, is formed with one or more rows of helical grooves 20*b* at a finite interval starting from the bottom of the core upward, wherein at least one row out of said rows of helical grooves 20*b* should start at a segment tip 30 mounted on the bottom of the core body 20, or one or more rows of helical grooves 20*b* may all start at the corresponding segment tips 30 mounted on the bottom of the core body 20.

According to the invention as constituted above, in the case of dry operation, the helical grooves have the effect of cooling the core drill 10 through the introduction of air and further stably maintaining the rotating speed of the core drill 10 through the reduced friction from smooth discharge of the cut scraps, resulting in elevation of working efficiency.

As indicated above, in the case of a core drill 10 mounted with the segment tips 30 including the recesses 30*d* or 30*e* as shown in FIG. 2*a*, 2*b*, 2*c* or 2*e*, the discharge of cut scraps (for dry operation) or wet sludge (for wet operation) is conducted effectively thanks to the direct connection of the helical grooves 20*b* with the corresponding recesses of segment tips 30, as proposed above according to the invention.

Preferably, the width of a recess 30*d* or 30*e* formed on a segment tip 30 is designed to correspond to that of a helical groove 20*b* on the core body 20. If need be, however, the width of a recess may be larger or smaller. In addition, most preferably, the angle or orientation of the recesses 30*d* or 30*e* on segment tips corresponds to that of the helical grooves on a core body 20, as indicated in FIG. 7.

For wet operation, the helical grooves 20*b* are used as channels for cooling water also so as to act to guide smooth passage of cooling water and smooth discharge of sludge and moreover eliminate working difficulty with irregular water emission during the initial stage of drilling, contributing to the improvement of workability.

As the angle of the helical groove 20*b*, wherein the angle is based on the horizontal, the range of 45° to 90° is appropriate to expedite the discharge of cut scraps for dry operation when the rotational speed is high, while for wet drilling operation with a lower speed, the range of 1° to 45° is appropriate for the stable discharge of sludge and introduction of cooling water.

Figure 8:
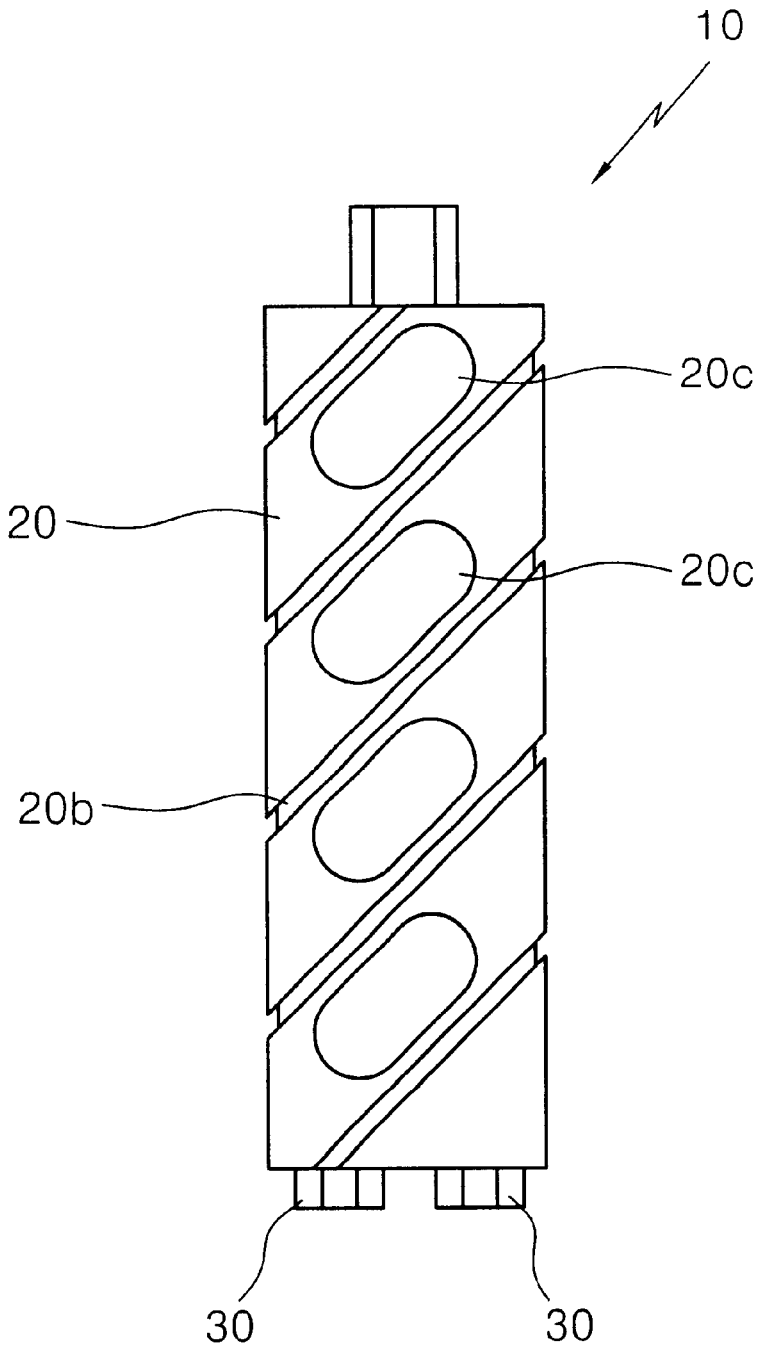

In FIG. 8 which represents a variant of the core drill, plural openings 20*c* communicating with the inside are disposed between the adjoining helical grooves 20*b* on the circumference of a core body 20.

These openings are intended to cause the core material from an article stuck inside the core body 20 to be taken out easily by applying impact thereon through these holes 20*c* by using a hand tool like a chisel.

Thus, the formation of these openings should take into account that the height of the core material produced becomes larger accordingly with that of a core body 20.

Further, these openings 20*c* serve as cooling passages as well in the case of a core drill operating on the dry basis and so help improve the workability.

While the openings shown in FIG. 8 are in the form of an ellipse, they are not restricted to that form but may be in the form of a circle, triangle, quadrangle or the like.

As described above, the present invention has the effect of improving the working efficiency by facilitating the initial settling of segment tips on an article to be processed through providing the tips with inclined sharp thickness portions and at the same time, has the effect of improving the cooling and cutting performance through smooth discharge of cut scraps or sludge with less friction by providing the core body with one or more rows of helical grooves and directly connecting the starting points of the grooves with the segment tips.

What is claimed is:

1. A core drill comprising a hollow cylindrical body defining a longitudinal axis, and cutting segment tips disposed at a front longitudinal end of the body, the segment tips being spaced apart in a circumferential direction of the body and being elongated in the circumferential direction, each cutting segment tip including a pair of non-parallel, forwardly converging surfaces that substantially intersect to form a cutting edge, the cutting edge being elongated in the circumferential direction.

2. The core drill according to claim 1 wherein one of the non-parallel surfaces is inclined relative to the axis in a direction extending both radially outwardly and axially forwardly.

3. The core drill according to claim 1 wherein one of the non-parallel surfaces is inclined relative to the axis in a direction extending both radially inwardly and axially forwardly.

4. The core drill according to claim 1, wherein one of the non-parallel surfaces being is inclined relative to the axis in a direction extending both radially outwardly and axially forwardly, and the other surface is inclined relative to the axis in a direction extending radially inwardly and axially forwardly.

5. The core drill according to claim 1 wherein the cutting edges of all of the cutting segment tips are spaced at the same instance from the axis.

6. The core drill according to claim 1 wherein the cutting edges of a first plurality of the cutting segment tips are spaced farther from the axis than are the cutting edges of a second plurality of the cutting segment tips, wherein the cutting segment tips of the first plurality alternate circumferentially with the cutting segment tips of the second plurality.

7. The core drill according to claim 1 further including a plurality of helical grooves formed in an outer cylindrical surface of the body, each groove extending all the way to the front longitudinal end of the body to locations at the front longitudinal end where respective cutting segment tips are disposed.

8. A core drill comprising a hollow cylindrical body defining a longitudinal axis, and cutting segment tips separately mounted at a front longitudinal end of the body, the cutting segment tips being spaced apart in a circumferential direction of the body and being elongated in the circumferential direction, at least one helical groove formed in an outer cylindrical surface of the body and extending all the way to the front longitudinal end of the body to a location at the front longitudinal end where one of the cutting segment tips is disposed.

9. The core drill according to claim 8 wherein the at least one groove defines an inclination angle in a range of 1° to 90°.

10. The core drill according to claim 8 wherein each cutting segment tip includes at least one recess disposed in a radially outer surface thereof, the recess defining an inclination angle corresponding to the inclination angle of the groove.

11. The core drill according to claim 8 wherein the at least one helical groove comprises a plurality of helical grooves, each helical groove extending all the way to the front longitudinal end to locations at the front longitudinal end where respective cutting segment tips are disposed.

12. The core drill according to claim 11 wherein the body includes openings extending through a cylindrical wall of the body, the openings situated between respective pairs of adjacent grooves.

* * * * *